US009765626B2

(12) United States Patent
Neubrand et al.

(10) Patent No.: US 9,765,626 B2
(45) Date of Patent: Sep. 19, 2017

(54) GAS TURBINE BLADE

(71) Applicant: ALSTOM Technology Ltd, Baden (CH)

(72) Inventors: Fabian Neubrand, Rheinfelden (DE); Willy Heinz Hofmann, Baden-Rütihof (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 299 days.

(21) Appl. No.: 14/661,661

(22) Filed: Mar. 18, 2015

(65) Prior Publication Data

US 2015/0345297 A1 Dec. 3, 2015

(30) Foreign Application Priority Data

Mar. 20, 2014 (EP) ..... 14160866

(51) Int. Cl.

| | |
|---|---|
| ***F01D 5/16*** | (2006.01) |
| ***F01D 5/14*** | (2006.01) |
| ***F01D 5/18*** | (2006.01) |
| ***F01D 9/02*** | (2006.01) |

(52) U.S. Cl.

CPC ..... *F01D 5/141* (2013.01); *F01D 5/148* (2013.01); *F01D 5/16* (2013.01); *F01D 5/186* (2013.01); *F01D 5/187* (2013.01); *F01D 9/02* (2013.01); *F05D 2220/32* (2013.01); *F05D 2250/70* (2013.01)

(58) Field of Classification Search

CPC ..... F01D 5/141; F01D 5/148; F01D 5/16
See application file for complete search history.

(56) References Cited

U.S. PATENT DOCUMENTS

| | | | | |
|---|---|---|---|---|
| 5,525,038 | A | 6/1996 | Sharma et al. | |
| 5,779,443 | A | 7/1998 | Haller et al. | |
| 6,428,281 | B1 | 8/2002 | Botrel et al. | |
| 7,217,101 | B2 * | 5/2007 | Harvey | F01D 5/141 416/223 A |
| 7,497,664 | B2 * | 3/2009 | Walter | F01D 5/141 416/223 A |

(Continued)

FOREIGN PATENT DOCUMENTS

| | | |
|---|---|---|
| EP | 1 046 783 A2 | 10/2000 |
| EP | 1 524 405 A2 | 4/2005 |

(Continued)

OTHER PUBLICATIONS

David Gordon Wilson, "The Design of High-Efficiency Turbomachinery and Gas Turbines", published by the MIT Press, Cambridge, Massachusetts, 1984, 5th printing 1991, pp. 487-492.

*Primary Examiner* — Dwayne J White
*Assistant Examiner* — Sabbir Hasan
(74) *Attorney, Agent, or Firm* — Buchanan Ingersoll & Rooney PC

(57) ABSTRACT

The invention refers to a gas turbine blade including an airfoil extending in radial direction from a blade root to a blade tip, defining a span ranging from 0% at the blade root to 100% at the blade tip, and extending in axial direction from a leading edge to a trailing edge, which limit a chord with an axial chord length defined by an axial length of a straight line connecting the leading edge and trailing edge of the airfoil depending on the span. The axial chord length increases at least from 80% span to 100% span.

12 Claims, 4 Drawing Sheets

(56) References Cited

U.S. PATENT DOCUMENTS

| | | | | |
|---|---|---|---|---|
| 8,485,787 | B2 * | 7/2013 | Marra | B21C 23/085 29/889.72 |
| 2005/0106027 | A1 | 5/2005 | Harvey | |
| 2006/0182633 | A1 | 8/2006 | Harvey | |
| 2010/0011674 | A1 | 1/2010 | Crettol et al. | |
| 2010/0054946 | A1 | 3/2010 | Orosa et al. | |
| 2011/0091327 | A1 | 4/2011 | Willett, Jr. | |
| 2013/0017094 | A1 | 1/2013 | Coupe et al. | |

FOREIGN PATENT DOCUMENTS

| | | | |
|---|---|---|---|
| EP | 1 754 859 | A2 | 2/2007 |
| EP | 1 898 052 | A2 | 3/2008 |
| EP | 1 953 344 | A1 | 8/2008 |
| EP | 2 022 988 | A1 | 2/2009 |
| GB | 2 407 136 | A | 4/2005 |
| GB | 2490127 | A | 10/2012 |

* cited by examiner

GAS TURBINE BLADE

CROSS-REFERENCE TO RELATED APPLICATIONS

This application claims priority to European application 14160866.1 filed Mar. 20, 2014, the contents of which are hereby incorporated in its entirety.

TECHNICAL FIELD

The invention relates to a gas turbine blade comprising an airfoil extending in radial direction from a blade root to a blade tip, defining a span ranging from 0% at the blade root to 100% at the blade tip, and extending in axial direction from a leading edge to a trailing edge, which limit a chord with an axial chord length defined by an axial length of a straight line connecting the leading edge and trailing edge of the airfoil depending on the span. Generally, the gas turbine blade according to the present invention is not restricted to a gas turbine: rotor blades or guide vanes of a turbomachinery fall legally under the present invention.

BACKGROUND

The design of rotor blades in a gas turbine engine is of vital importance in terms of efficiency with which the gas flow passing through the gas turbine engine interacts with the blades especially of the at least one turbine of the gas turbine arrangement.

Rotating gas turbine blades must fulfill a multitude of material- and design criteria which consider high mechanical and thermal stresses acting onto the rotating blades during operation. Due to enormous centrifugal forces acting onto rotating blades and an enormous thermal load that must withstand the blades, the main task in the design work of blades is to combine a high degree on stiffness which shall avoid blade vibrations during operation and the possibility of active cooling to enhance load capacity, by providing cooling channels inside the airfoil of a rotating blade. In view of the before requirements an optimized airfoil shape is always sought to improve turbine aerodynamic efficiency.

Rotating blades are arranged in rows which alternate in axial direction with rows of stationary vanes. Every pair of rows includes one row of stationary vanes and one row of rotating blades which follows in downstream direction directly forms a so-called stage. All stages of the turbine are numbered in sequence beginning with the first stage at the inlet opening of the turbine comprising the first row of stationary vanes followed by the first row of rotating blades.

Normal operation of a gas turbine shows that the stationary vanes, e.g. of the first stage, are excitation sources for vibrations acting onto the following rotating blades in downstream direction in disadvantage manner. It is therefore an object of turbine development to reduce such excitation sources and/or to enhance possibilities of decoupling mechanism to reduce and/or to avoid vibration transmission and excitation onto rotating blades arranged downstream of vanes in the first stage.

An obvious intervention would mean to change the excitation sources itself, but a change of the vanes in the first stage is considered to be expensive and would raise a lot of development work. Proposals to vary the radial length of the blades, i.e. the span of the airfoil which extends from the blade root to the blade tip, would have an impact onto the annulus of the flow path through the turbine which would lead to a major impact on a developments schedule which in view of that is not favorable. Another approach of reducing the tip mass of the rotating blade by reducing the axial chord length of the tip chord, which concerns a straight line connecting the leading edge and trailing edge of the airfoil in the region of the blade tip, resulted in aerodynamic penalty and furthermore a desired frequency shift of the resonant vibration behavior of the rotating blade was not achieved. Finally it was thought about to change the blade material in view of a possible change of Young's modulus, but this idea was dropped because of low cycle fatigue limitations associated with conventionally cast and directionally solidified materials.

All approaches of a desired influence on the vibration behavior of the rotating blades especially arranged within the first stage of a turbine and the turbine aerodynamic efficiency show the complexity of the problem. Major mass redistribution in designing an enhanced shape of the airfoil of a rotating blade is also considered to be especially difficult because rotating blades of the front stages are actively cooled components which are hollow bodies containing a multitude of cooling channel for cooling purpose. The thin metal walls of the rotating blades have to be cooled intensively to fulfill target life. Also the aspect of increasing the shank length of a rotating blade was considered to influence the vibration behavior of the rotating blade itself but was not deemed to be favorable due to the fact that this approach would result in rotor limits at the fire tree region in which cooling air supply via rotor bores is provided so that the rotor outline would also have to be adjusted.

The document U.S. Pat. No. 5,525,038 discloses a rotor blade for a gas turbine engine which is optimized to reduce tip leakage through a tip clearance. The rotor blade provides a significantly bowed surface formed at the tip region extending from the leading edge to the trailing edge of the suction side of the rotor blade. The profile cross-sections along the span of the airfoil of the rotor blade do not vary significantly, at least the axial chord length of the airfoil along the whole span of the rotor blade remains unchanged.

The axial chord length is defined as the length of the projection of the blade, as set in the turbine, onto a line parallel to the turbine axis. This can be seen in for example David Gordon Wilson's "The Design of High-Efficiency Turbomachinery and Gas Turbines", pp 487-492, published by the MIT Press, Cambridge, Mass., 1984, 5th printing 1991. Particular reference is made to the second figure on page 487.

SUMMARY

It is an object of the invention to provide a gas turbine engine rotor blade comprising an airfoil extending in radial direction from a blade root to a blade tip, defining a span ranging from 0% at the blade root to 100% at the blade tip, and extending in axial direction from a leading edge to a trailing edge, which limit a chord with an axial chord length defined by an axial length of a straight line connecting the leading edge and trailing edge of the airfoil depending on the span which provides an enhanced vibration behavior such that resonance excitation does not occur at the rotating blades of the first and following stages.

The object is achieved by the features in the independent claim 1. The invention can be modified advantageously by the features disclosed in the dependent claims as well in the following description especially referring to preferred embodiments.

It has been recognized according to the invention that by increasing the axial chord length at least in a span region from 80% span to 100% span, a significant influence on the resonant vibration behavior of the rotating blade can be exerted without a deterioration of the aerodynamic properties of the airfoil of the rotating blade. The increase of axial chord length is directly combined with an increase of mass in the region of the airfoil tip which influences the mechanical properties, in particular the Eigenfrequencies of the rotating blade.

In a preferred embodiment of the invention the axial chord length of the airfoil of the gas turbine blade increases continuously at least from 70% span to 100% span. advantageously the increase of the axial chord length with increasing span is more or less symmetrical relative to a so called stacking line which is a line on the surface at the pressure side of the airfoil extending from 0% to 100% span at an axial position of 50%±5% of axial chord length.

The inventive gas turbine blade provides in view of its axial chord length a minimum at least in the range between 50%±10% span and 70%±10% span, i.e. the airfoil of the gas turbine blade between 0% span and 50%±10% span is formed with a conventional shape which provides a decreasing axial chord length from 0% span to 50%±10% span. Towards the tip the chord length is increasing again.

An optimized embodiment of an inventive gas turbine blade provides an axial chord length which increases from 50% span to 100% span and provides a minimal axial chord length at 50% span.

The axial increase of the axial chord length in the range between the tailored mid region of the airfoil to the airfoil tip, i.e. 100% span ranges between 5%±5% and 15%±10% of the axial chord length in the tailored mid region of the airfoil.

As a result of the increase of axial chord length along the radial upper part of the airfoil of the turbine blade influence on the eigenfrequency of the turbine blade can be exerted such that the eigenfrequency can be modified in an amount so that resonant excitation can be minimized or even excluded.

To increase the difference between the eigen frequency of the gas turbine blade to the excitation frequency caused by stationary vanes in the first stage even more it is further proposed to bend the leading and trailing edge in the radial upper region of the airfoil additionally. Preferably the bending of the leading and trailing edge depend on a curvature of a stacking line which was already explained before, which is a line on the surface at the pressure side of the airfoil extending from 0% to 100% span at an axial position of 50%±5% of axial chord length. The stacking line is bended in the span region between 50%+10% span and 100% span such that the stacking line encircles at 100% span an angle $\alpha$ with a virtual plane oriented orthogonal to the radial direction and wherein the angle $\alpha$ lies within a plane defined by the stacking line and the radial direction such that for the angle $\alpha$ applies: $12.5°\pm2.5°\leq\alpha\leq25°\pm5°$.

For the sake of completeness it should be mentioned that the stacking line can be kept straight between 5%±5% span and 50%±10% span.

Preferably the stacking line provides a curvature within the span region between 50%±10% span and 100% span which is defined by one single radius.

In a further preferred embodiment the rotating blade provides an aspect ratio concerning span to axial chord length at 5%±5% span ranging from 1.6 to 2.1. In case of blades having different span dimensions along the leading and trailing edge the before aspect ratio concerns the span dimension along the trailing edge.

DESCRIPTION OF THE DRAWINGS

The invention shall subsequently be explained in more detail based on exemplary embodiments in conjunction with the drawings. In the drawings

DETAILED DESCRIPTION

Figure 1:
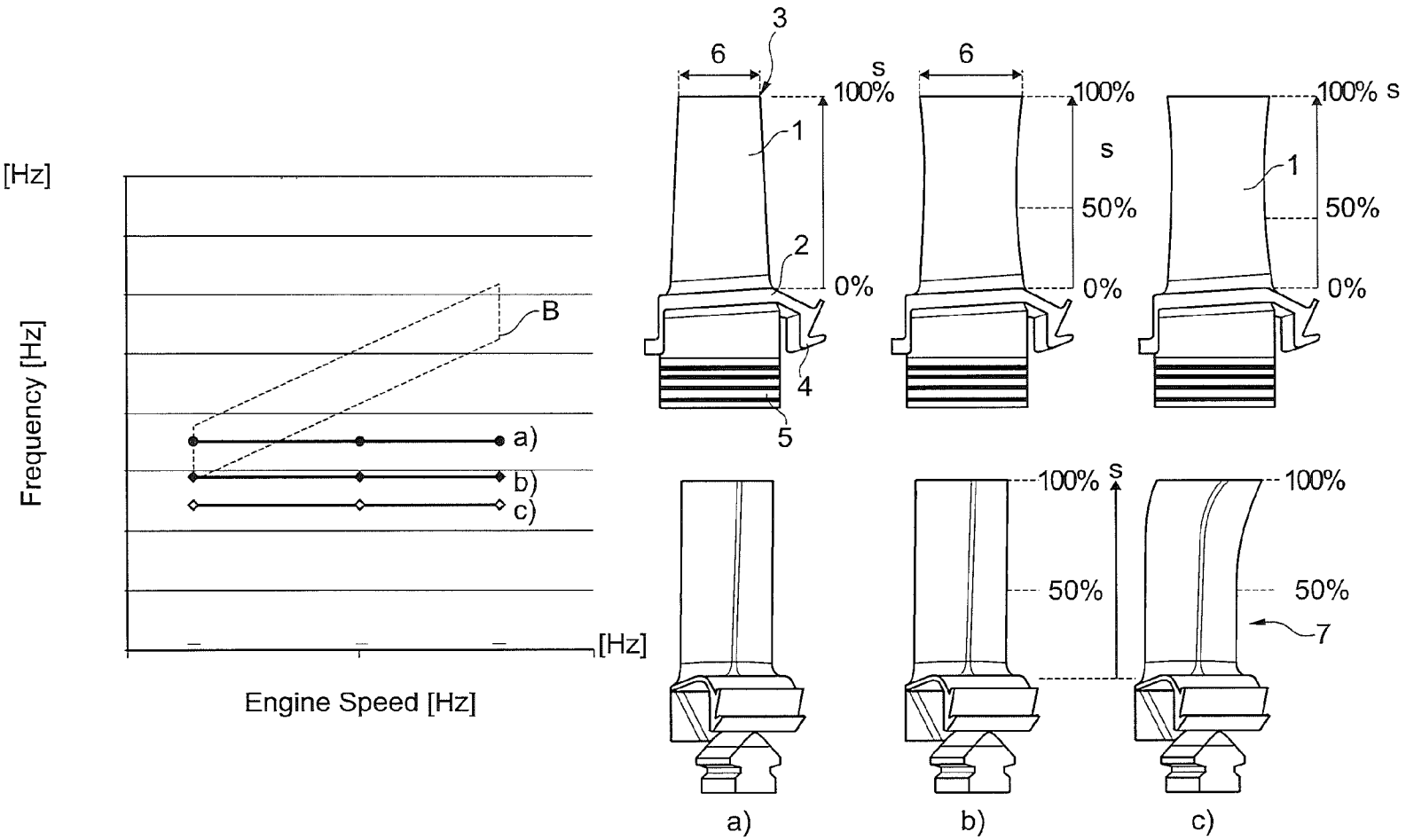
FIG. 1 shows on the left hand side a diagram which illustrates resonance frequency behavior, e.g. of vanes and blades in the front stage of a gas turbine, FIG. 2 three side view presentation of an enhanced embodiment of the inventive turbine blade and FIG. 3*a, b* perspective view on the inventive turbine blade and a top view of vertical stacked airfoil cross sections.

FIG. 1 shows on the left hand side a diagram which illustrates resonance frequency behavior of vanes and blades in the first stage of a gas turbine. Along the abscissa of the diagram values are indicated representing the engine speed. Along the ordinate of the diagram vibrating frequency are indicated. The dashed line box B indicates the source of excitation depending on the engine speed, in which resonance excitation of the blades of the gas turbine can occur.

On the right hand side of FIG. 1 three different embodiments a), b) c) of rotor blades of a gas turbine are illustrates. The upper view in each case shows a side view of a rotor blade and the corresponding lower view shows the blade in a perspective front view.

Case a) shows a rotor blade commonly used in gas turbines and represents the state of the art. The common rotor blade provides an airfoil 1 which extends radially from a blade root 2 to the blade tip 3. The blade root 2 comprises a shroud 4 and a fire tree shaped blade foot 5 for fixing purpose inside the rotor arrangement. As can be seen from the upper sketch in case a) the commonly known rotor blade provides an airfoil 1 providing a axial chord length 6 which decreases along the whole span from 0% span to 100% span. The rotor blade illustrated in case a) comprises an eigenfrequency which overlaps with the excitation frequency represented by the dashed line box B in the diagram shown in FIG. 1 left hand side. This leads to a reduced life time due to a high amount of vibrational impact.

In case b) an inventive improved rotor blade is illustrated having an airfoil 1 which provides an axial chord length 6 which increases in a span region s from 50% span to 100% span. As can be seen from the side view in the upper sketch in case b) the airfoil 1 has a minimum axial chord length 6 in the range of 50% span. The increase of the axial chord length 6 can also be derived from the front view sketch in the lower part of case b).

The inventive action contributes that the eigenfrequency of the improved airfoil is dropped in comparison to the commonly known blade of case a). Due to the increase of mass in the tip range of the airfoil in case b) the eigenfrequency drops below which means in case of the situation illustrated in the diagram of FIG. 1 left hand side there is nearly no overlap between the resonance frequency of the blade of case b) and the excitation frequency range indicated by the dashed line box B. Therefore the improved blade illustrated in case b) provides a significant enhanced vibrational behavior which is clearly robust against vibrational excitation. This leads to an effective enhancement of the aerodynamic behavior and prolongs lifetime of the blade clearly.

Case c) which is illustrated at the right side of FIG. 1 shows a rotor blade which provides an axial chord length increase as explained in case b), which can be derived from the upper view in case c) but additionally provides a bending of the airfoil 1 in circumferential direction towards the suction side 7 of the airfoil 1. Bending of the airfoil 1 is limited in a span region preferably between 50% span and 100% span which can be derived from the lower sketch of case c). The additional bending of the airfoil 1 as described before and as will be discussed in more detail below leads to an enhanced frequency behavior of the rotor blade which is illustrated in the diagram of FIG. 1 left hand side. The eigenfrequency of a rotor blade as disclosed in case c) provides a significant lower eigenfrequency which is clearly below the airfoil illustrated in case b). This leads to a significant frequency separation relative to the excitation frequency characterized by the dashed line box B of FIG. 1.

Figure 2:
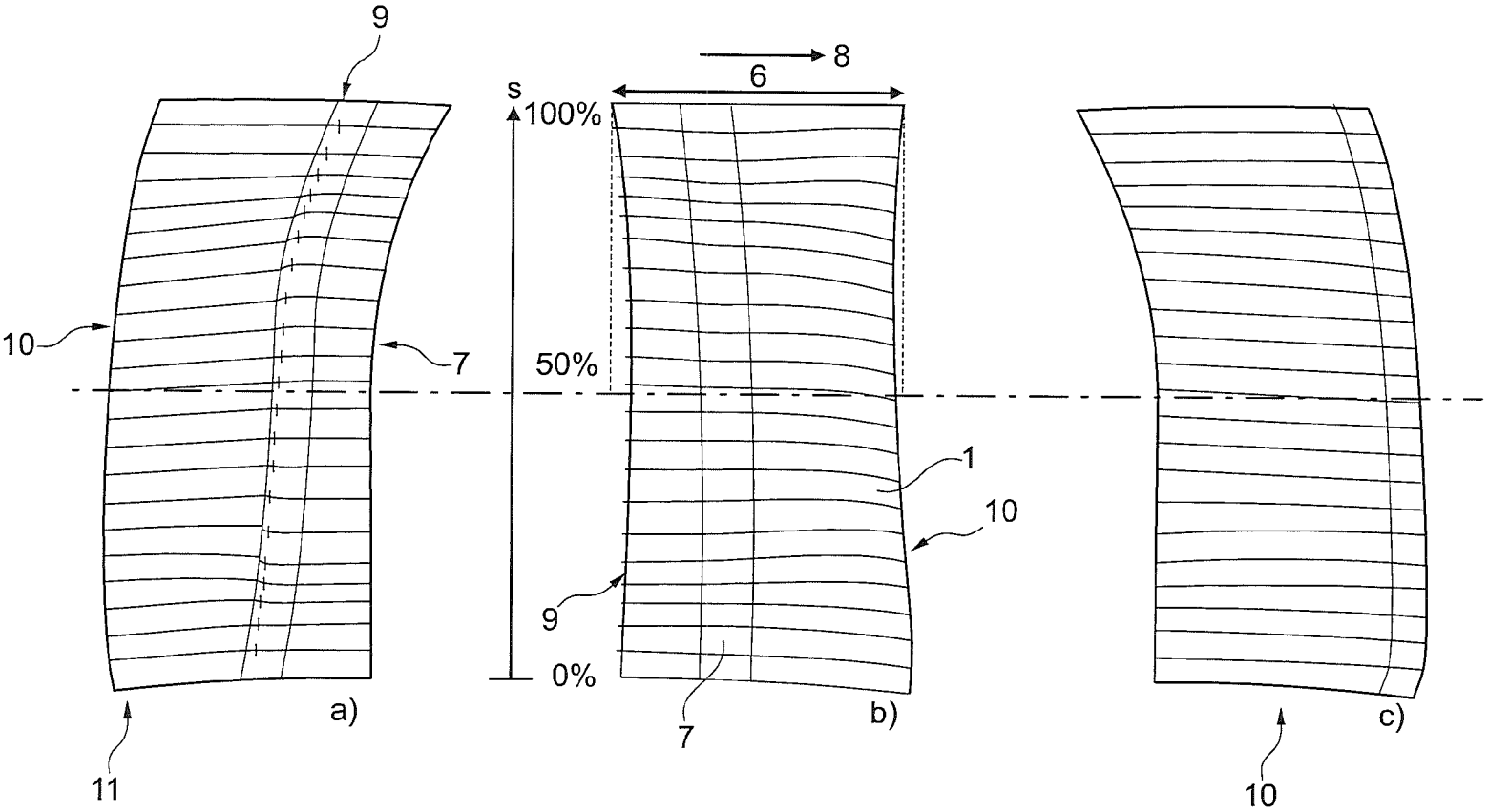

FIG. 2 *a, b, c* show a three side view presentation of an inventive rotor blade as introduced shortly in case c) of FIG. 1. The FIG. 2*a* shows a front view, FIG. 2*b* shows the side view and FIG. 2*c* shows the rear view of an inventively formed rotor blade.

In FIG. 2*b* it is assumed that the flow direction 8 of the gas flow in a turbine is directed from the left hand side to the right hand side, so that the left edge of the illustration represents the leading edge 9 and the right edge represents the rear edge 10 of the airfoil 1. The suction side 7 of the airfoil 1 in FIG. 2*b* faces towards the observer. The blade has an radially extension which is called span s which extends from 0% span at the blade root (not shown) to 100% span which corresponds to the blade tip 3. The axial chord length 6 varies along the whole span s but increases inventively from a mid range span preferably from 50% span to 100% span. The increase of axial chord length 6 leads automatically to an increase of mass in the blade tip region which influences the resonance frequency of the rotor blade significantly. The amount of increase of the axial chord length 6 from the mid-range span region to 100% span is about 5%±5% to 15%±10% related to the axial chord length 6 of 50% span of the airfoil 1. This increase is illustrated in FIG. 2*b* by the vertical dashed lines.

As can be seen from the front view of FIG. 2*a* the leading edge 9 is bended as well the rear edge 10 which cannot be seen on the front view in a span range between 50% span and 100% span. The bending is oriented towards the suction side 7 of the airfoil 1 of the rotor blade. Bending of the leading edge 9 as well of the rear edge 10 is defined by a curvature of a so called stacking line which is a line on the surface at the pressure side 11 of the airfoil 1 extending from 0% to 100% span at an axial position of 50.+−0.5% of axial chord length 6. The curvature of the stacking line within the span region between 50% and 100% span is defined by one single radius preferably which can be seen more clearly in FIG. 3*a*.

Figure 3A:
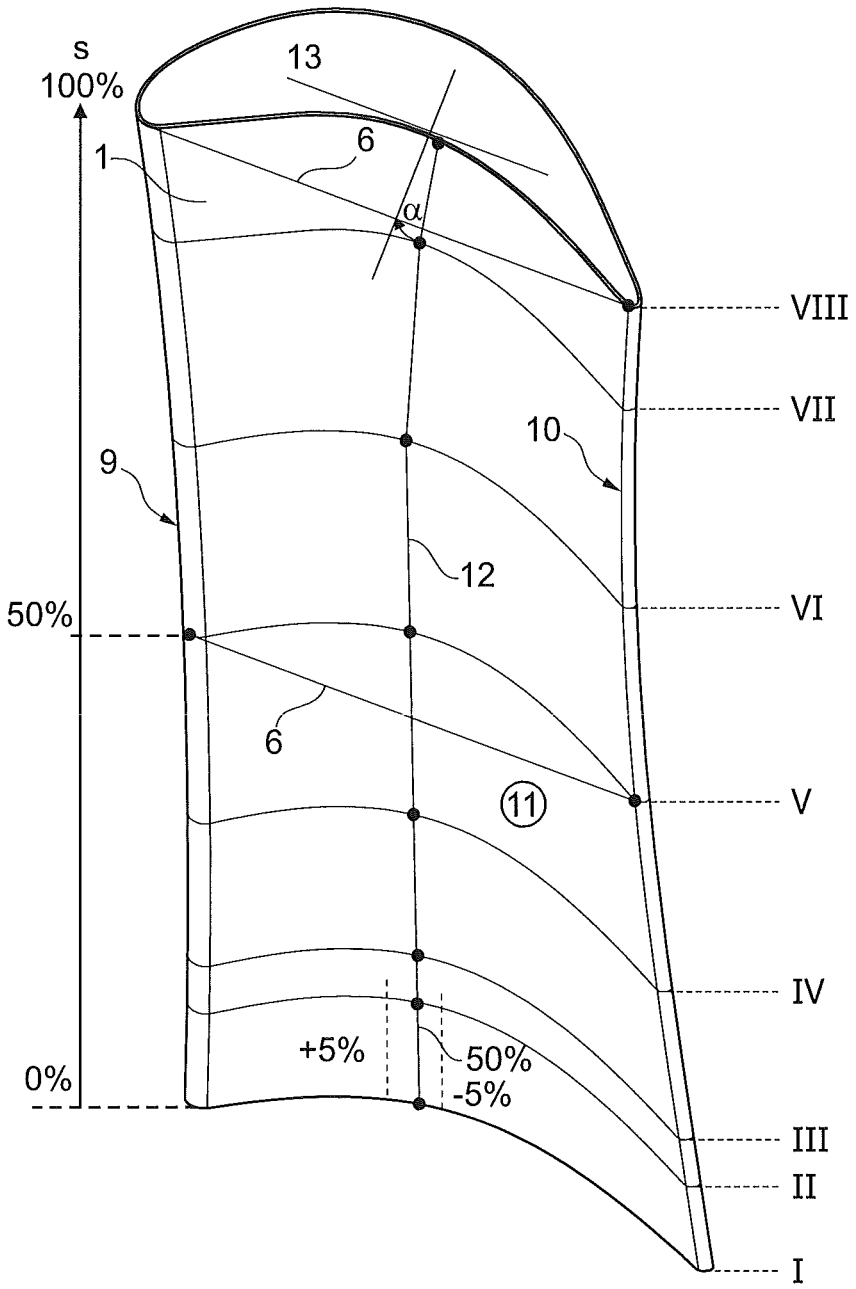

FIG. 3*a* shows a perspective view onto the pressure side 11 of an inventive airfoil 1 providing both, an increase of axial chord length 6 in the span range between 50% and 100% span and bending of the leading edge 9 and rear edge 10 within the span region between 50% and 100% span. The bending of the leading 9 and trailing edge 10 depend on the curvature of the stacking line 12 which can be seen in FIG. 3*a* which is the line on the surface of the pressure side 11 extending from 0% to 100% span at an axial position of 50%±5% of axial chord length 6. The stacking line 12 is almost straight between 0% span and 50%±10% span and is bended in the span region between 50%±10% span and 100% span such that the stacking line 12 encircles at 100% span an angle α with the virtual plane 13 orientated orthogonal to the radial direction and wherein the angle α lies within a plane defined by the stacking line and the radial direction such that the angle α is between 12.5°±2.5° and 25°±5°. The curvature of the stacking line within the upper span region is defined by on single radius preferably. In other preferred embodiments the stacking line additionally can provide at least one straight section along the upper span region.

Figure 3B:
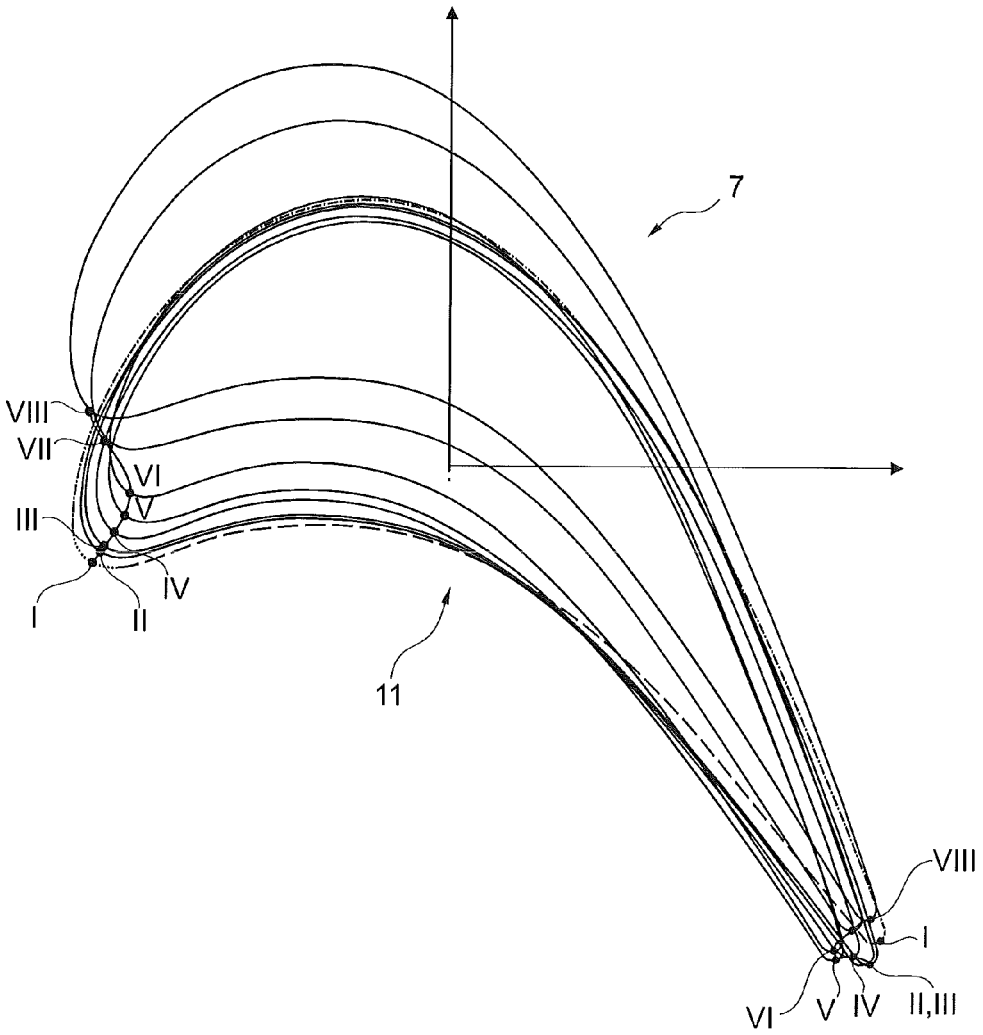

FIG. 3*b* shows a vertical projection of different profile cross-sections through the airfoil 1 at different span regions which are indicated in FIG. 3*a* by roman numerals I to VIII. The profile cross section I corresponds to the profile cross-section at 0% span and the profile cross section VIII corresponds to the profile cross-section at 100% span. The vertical projection in radial direction shows a significant geometrical offset of the profile cross section within the span region 50% span to 100% i.e. the profile cross sections V to VIII. The geometrical offset is caused both by an offset in circumferential direction towards the suction side 7 of the airfoil 1 and further by an increase of axial chord length 6 from 50% span to 100% span.

The invention claimed is:

1. A gas turbine comprising an airfoil extending in radial direction from a blade root to a blade tip, defining a span ranging from 0% at the blade root to 100% at the blade tip, and extending in axial direction from a leading edge to a trailing edge, which limit a chord with an axial chord length defined by an axial length of a straight line connecting the leading edge and trailing edge of the airfoil depending on the span, wherein the axial chord length increases at least from 80% span to 100% span and the axial chord length provides a minimum at least in the range between 50%±10% span and 70%±10% span.

2. The gas turbine blade according to claim 1, wherein the axial chord length increases at least from 70% to 100% span.

3. The gas turbine blade according to claim 1, wherein the axial chord length increases from 50% span to 100% span and provides a minimum at 50% span.

4. The gas turbine blade according to claim 1, wherein the leading edge and the tailing edge separate a suction and a pressure surface of the airfoil, both surfaces extending radially between the blade root and the blade tip and axially between the leading and trailing edge and being mutually opposed surfaces of the airfoil along a circumferential direction which is orthogonal to the axial and radial direction, and that the leading and trailing edge are bent within at least one span region.

5. The gas turbine blade according to claim 4, wherein the leading and the trailing edge are bent in a circumferential direction towards the suction surface side of the airfoil.

6. The gas turbine blade according to claim 4, wherein the at least one span region is between 50%±10% span and 100% span.

7. The gas turbine blade according to claim 4, wherein bending of the leading and trailing edge depend on a curvature of a stacking line which is a line on the surface at the pressure side of the airfoil extending from 0% to 100% span at an axial position of 50%±5% of axial chord length, and said stacking line is bent in the span region between 50%±10% span and 100% span such that the stacking line encircles at 100% span at an angle α with a virtual plane oriented orthogonal to the radial direction, wherein the angle α is in a plane defined by the stacking line and the radial direction, for the angle applies:

$$(12.5°\pm2.5°)\leq\alpha\leq(25°\pm5°).$$

8. The gas turbine blade according to claim 7, wherein the stacking line is straight between 0% span and 50%±10% span.

9. The gas turbine blade according to claim 7, wherein stacking line provides a curvature within the span direction, and the curvature is defined by one single radius.

10. The gas turbine blade according to claim 1, wherein the blade is an activity-cooled rotating turbine blade having cooling channels inside the airfoil.

11. A gas turbine blade according to claim 1, wherein the blade provides an aspect ratio span/axial chord length at 5%±5% span ranging from 1.6 to 2.1.

12. The gas turbine blade according to claim 1, wherein the blade is suitable for use as a rotor blade or a guide blade vane of a turbo-machinery.

* * * * *